US007119481B2

(12) United States Patent
Krieglmeyer

(10) Patent No.: US 7,119,481 B2
(45) Date of Patent: Oct. 10, 2006

(54) REFLECTOR LAMP HAVING A PLASTIC REFLECTOR SUPPORTING LUGS COUPLED BY BARBS

(75) Inventor: Christoph Krieglmeyer, Hofstetten (DE)

(73) Assignee: Patent- Treuhand-Gesellschaft fur elektrische Gluhlampen mbH, Munich (DE)

( * ) Notice: Subject to any disclaimer, the term of this patent is extended or adjusted under 35 U.S.C. 154(b) by 246 days.

(21) Appl. No.: 10/758,418

(22) Filed: Jan. 16, 2004

(65) Prior Publication Data

US 2004/0150308 A1 Aug. 5, 2004

(30) Foreign Application Priority Data

Jan. 24, 2003 (DE) ..... 103 02 931

(51) Int. Cl.
*H01J 5/16* (2006.01)

(52) U.S. Cl. ..... 313/113; 313/318.09; 313/318.11

(58) Field of Classification Search ..... 313/113, 313/318.11, 318.09; 359/868, 869; 362/296, 362/341, 347–350
See application file for complete search history.

(56) References Cited

U.S. PATENT DOCUMENTS

| | | | | |
|---|---|---|---|---|
| 4,623,815 A | | 11/1986 | Krieg et al. | |
| 5,367,219 A | * | 11/1994 | Friederichs | 313/113 |
| 5,534,742 A | * | 7/1996 | Krapp et al. | 313/113 |
| 5,744,901 A | * | 4/1998 | Friederichs et al. | 313/113 |
| 6,111,359 A | * | 8/2000 | Work et al. | 315/56 |

FOREIGN PATENT DOCUMENTS

| | | |
|---|---|---|
| DE | 83 10 715.0 | 12/1983 |

* cited by examiner

*Primary Examiner*—Edward J. Glick
*Assistant Examiner*—Thomas R. Artman
(74) *Attorney, Agent, or Firm*—William E. Meyer

(57) ABSTRACT

The invention relates to a reflector for an electric lamp, and a reflector lamp having an improved fastening of the electric contacts. The reflector body consists of an electrically insulating plastic and, for the purpose of making electric contact with the lamp, has contact lugs that are fixed at least two different locations on the outer side of the reflector body with the aid of claws or barbs integrally formed on the contact lugs.

10 Claims, 2 Drawing Sheets

REFLECTOR LAMP HAVING A PLASTIC REFLECTOR SUPPORTING LUGS COUPLED BY BARBS

I. TECHNICAL FIELD

Figure 1:
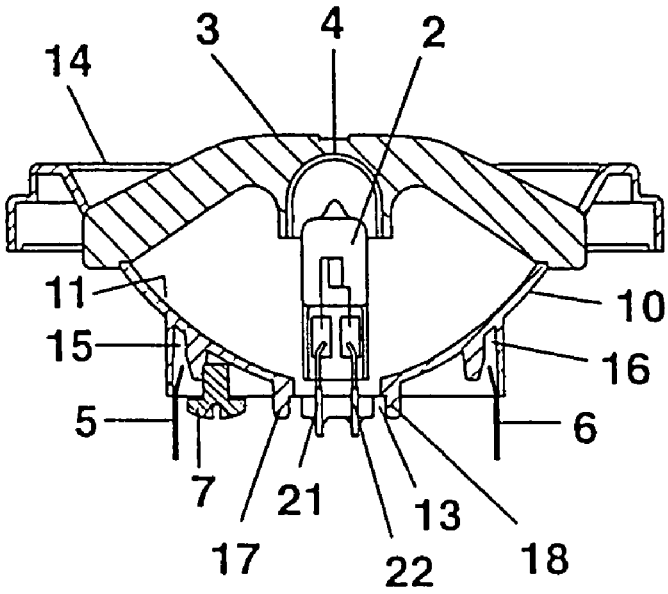

The invention relates to a reflector for an electric lamp, wherein the reflector has a reflector body with an inner side, designed in an optically reflecting fashion, and an outer side as well as at least one cutout for the lamp or for a lamp part, and at least one metallic contact element that is designed as an angular contact lug being fastened on the outer side of the reflector body.

II. BACKGROUND ART

Such a reflector and such a reflector lamp are disclosed, for example, in the German utility model with the register number G 83 10 715.0. This utility model describes a reflector lamp having a parabolic aluminum reflector and a halogen incandescent lamp fixed therein. Serving to fix the lamp in the reflector is a ceramic base insulator on which there are fastened two electric contact lugs that, for their part, are respectively welded to a supply lead of the lamp that projects through a cutout in the reflector. The base insulator is fastened on the reflector by means of four lugs that are integrally formed on the reflector and angled off from the latter.

III. DISCLOSURE OF THE INVENTION

It is the object of the invention to specify for a reflector of the generic type and for a reflector lamp of the generic type an improved fastening of the electric contact elements for the lamp arranged in the reflector.

This object is achieved by a reflector for an electric lamp, wherein the reflector has a reflector body with an inner side, designed in an optically reflecting fashion, and an outer side as well as at least one cutout for the lamp or for a lamp part, and at least one metallic contact element that is designed as an angular contact lug being fastened on the outer side of the reflector body, and wherein said reflector body consists of an electrically insulating plastic, and said at least one contact lug is fixed at least two different locations of the reflector body with the aid of claws or barbs that are integrally formed on said at least one contact lug. Particularly advantageous designs of the invention are described in the dependent patent claims.

The reflector according to the invention and the reflector lamp according to the invention have a reflector body consisting of an electrically insulating plastic and which is provided with an optically reflecting inner side and an outer side as well as with at least one cutout for the lamp or for a lamp part. The reflector or the reflector lamp has at least one contact lug that is fixed on the reflector body at at least two different locations of the reflector body by means of claws or barbs that are integrally formed on at least one contact lug.

Owing to the inventive combination of the above-named features of the reflector and the reflector lamp, it is possible to dispense with the use of a ceramic base insulator in accordance with the utility model cited above. Since the reflector body consists of an electrically insulating material instead of aluminum, there is no need for electrical insulation between the electric contact elements and the reflector in order to avoid a short circuit between the lamp supply leads. The contact lugs provided with claws or barbs can be secured by claws in the material of the plastic reflector, and thus enable the contact lugs to be fixed on the reflector in a simple way.

The reflector body advantageously has at least one pin integrally formed on its outer side, and a first limb of the at least one angular contact lug has a cutout in which the at least one pin is arranged with a clamping fit, the rim of the aforesaid cutout being provided with claws or barbs. Alternatively, or in addition to this, the at least one angular contact lug advantageously has a part that extends transverse to its first limb and is equipped with at least one claw or one barb and is arranged in a depression on the outer side of the reflector body. The at least one contact lug is preferably fastened on the reflector body by means of such a pin and of a part of the at least one contact lug extending transverse to the first limb. Alternatively, the at least one contact lug can also be fixed on the reflector body by means of two such pins or two parts of the at least one contact lug extending transverse to the first limb. The claws or barbs of the at least one contact lug are fastened by claws or barbs in the plastic material of the pins or in the plastic walls of the depressions on the reflector outer side.

The part of the contact lug that is provided with the claws or barbs and extends transverse to the first limb is advantageously designed as a component of its second limb that is angled off from the first limb and serves the purpose of insertion into a corresponding lamp holder. This measure provides a particularly high mechanical stability of the contact lug, because the part of the contact lug that is provided with the at least one barb and is secured by claws in the reflector body is thereby arranged in opposition to that section of the contact lug which is provided for insertion into the lamp holder. Moreover, at least one section of the second limb of the at least one contact lug is advantageously of two-ply design, in order further to increase the mechanical stability of the contact lug.

That section of the second limb of the at least one contact lug which is provided for insertion into a lamp holder is advantageously of two-ply design, that is to say the free end of the second limb of the at least one contact lug is bent back by an angle of 180 degrees. The part of the contact lug that is equipped with the at least one barb preferably forms the end of the second limb of the contact lug that is of single-ply design and extends diametrically in relation to the section of two-ply design.

The first limb of the at least one contact lug advantageously has a cutout in which the at least one supply lead of the lamp is arranged. A welded connection preferably exists between the at least one supply lead and the at least one contact lug.

IV. BRIEF DESCRIPTION OF THE DRAWINGS

Figure 2:
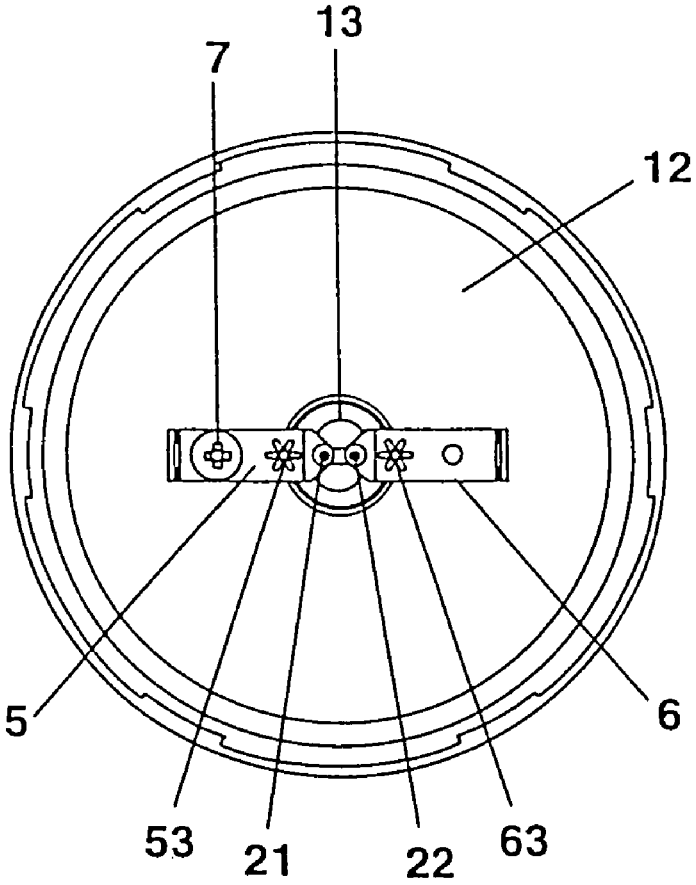
Figure 3:
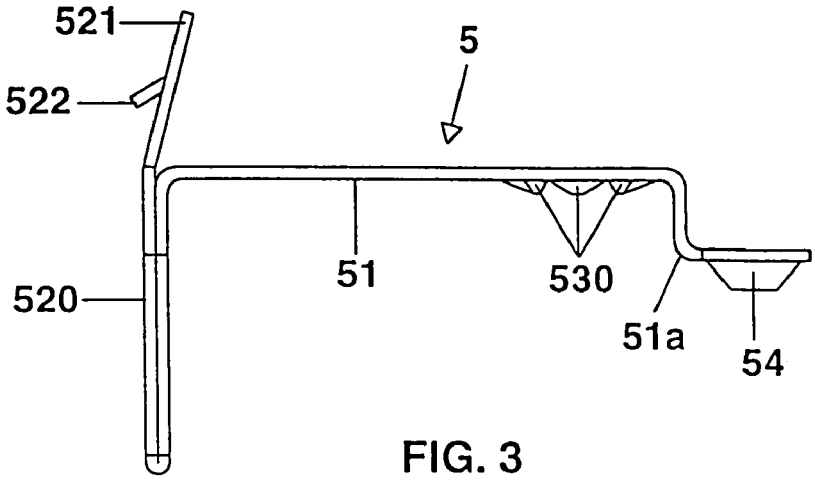
Figure 4:
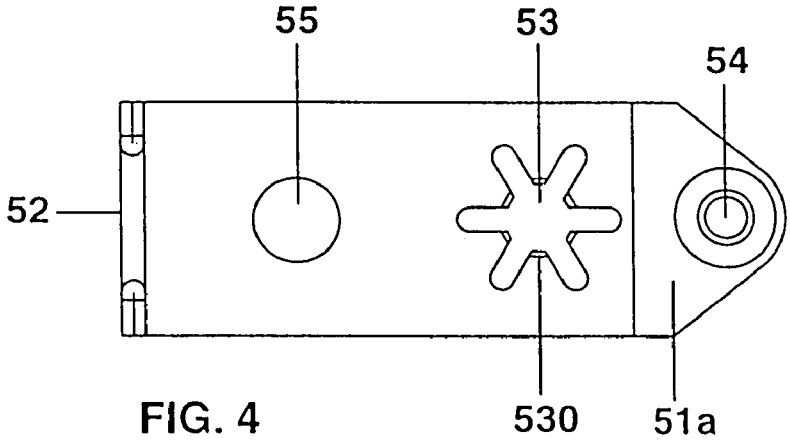
Figure 5:
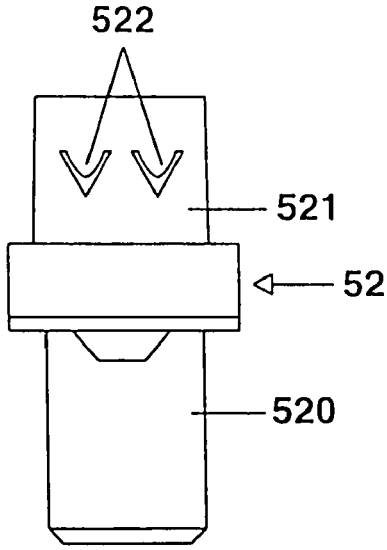

The invention is explained in more detail below with the aid of a preferred exemplary embodiment. In the drawings:

FIG. 1 shows a schematic side view of the reflector lamp in accordance with the preferred exemplary embodiment of the invention, in a sectioned representation, FIG. 2 shows a plan view of the outer side of the reflector and of the contact lugs of FIG. 1, FIG. 3 shows a plan view of a contact lug of the reflector lamp depicted in FIG. 1, FIG. 4 shows a first side view of the contact lug depicted in FIG. 3, and FIG. 5 shows a second side view of the contact lug depicted in FIG. 3.

V. BEST MODE FOR CARRYING OUT THE INVENTION

The preferred exemplary embodiment of the invention depicted in FIG. 1 is a reflector lamp that comprises a parabolic reflector and a halogen incandescent lamp 2 permanently fixed therein. The lamp 2 has a nominal voltage of 12 volts and an electric power consumption of approximately 50 watts. The reflector has a parabolic reflector body 10 consisting of an electrically insulating plastic, preferably of polyphenylene sulfide, with an outside diameter of 111 mm. The parabolic reflector body 10 has an inner side 11, designed in an optically reflecting fashion, an outer side 12 and a cutout 13, arranged at the vertex of the reflector body 10, for the halogen incandescent lamp 2. The inner side 11 of the reflector body 10 faces the lamp. The lamp is arranged on the optical axis of the reflector such that its two supply leads 21, 22 project through the cutout 13. Fastened on the reflector body 10 is a bow 3 that extends along the diameter of the reflector and bears a shield 4 for the halogen incandescent lamp 2. The rim 14, bounding the light exit opening, of the reflector body 10 is designed in an inside-out fashion. Two angular metallic contact lugs 5, 6 are fastened on the outer side 12 of the reflector body 10 and are connected in an electrically conducting fashion to in each case one of the supply leads 21 and 22, respectively. The contact lugs 5, 6 are formed as a standardized G53 base. The contact lugs 5, 6 are provided in each case with a locking screw 7 (only one being illustrated in FIG. 1) for the purpose of fixing connecting cables (not depicted). FIG. 2 shows the outer side of the reflector in the region of the cutout 13 at its vertex.

Details of the contact lug 5 are depicted in the enlarged illustration of FIGS. 3 to 5. The other contact lug 6 is of identical design.

The contact lug 5 comprises a sheet metal stamping with a thickness of 0.40 mm. It has a first limb 51 and a second limb 52 that is angled off from the first limb 51 by an angle of approximately 90 degrees. The first limb 51 has a cutout 53 whose rim is provided with five teeth 530 that narrow the cutout 53. Contact lug 6 is similarly formed with a cutout 63. The teeth 530 are bent slightly out of the plane of the first limb 51. After the mounting of the contact lug 5 on the reflector body 10, a pin 17 integrally formed on the outer side 12 of the reflector body 10 extends through the cutout 53 such that the teeth 530 bear against the pin 17 and engage therein like claws. The free end 51 a of the first limb 51 is designed in steps, and has a further cutout 54 for accommodating the lamp supply lead 22. The first limb 51 also has a threaded hole 55 for the locking screw 7.

The second limb 52 of the angular contact lug 5 has a section 520 of two-ply design that immediately follows the first limb 51 and is arranged at right angles to the first limb 51. This two-ply section 520 serves the purpose of insertion into a lamp holder appropriately coordinated with the G53 base. The free end 521 of the second limb 52 is of single-ply design and is provided with two blanked barbs 522 that are bent out of the plane of the free end 521. The free end 521 encloses an angle of 80 degrees with the first limb 51, and an angle of 190 degrees with the two-ply section 520. Formulated in other words, this means that the second limb 52 is angled off from the first limb 51 at an angle of 90 degrees, bent back by an angle of 180 degrees at a spacing of 11.28 mm, and at its free end 521 angled off from the plane of the two-ply section 520 at the level of the first limb 51 by an angle of 10 degrees, such that the free end 521 of the second limb 52 encloses an angle of 80 degrees with the first limb 51. The two-ply section 520 therefore has a length of approximately 11.3 mm. The free end 521 of the second limb 52 of the contact lug 5 is arranged in the depression 15 on the outer side 12 of the reflector body 10 and is attached in clawlike fashion there by means of the barbs 522. The other contact lug 6 is fixed in a similar way in the depression 16 and on the pin 18. The lamp 2 is borne in the reflector exclusively by the supply leads 21, 22 welded to the contact lugs 5, 6. However, it is also possible for the purpose of further stabilization and increasing the vibration resistance to provide an annular spacer that is arranged between the vessel of the lamp 2 and the rim of the cutout 13, and serves the purpose of supporting the lamp 2 at the rim of the cutout 13.

The invention is not limited to the preferred exemplary embodiment explained in more detail above. For example, the section 521 secured in clawlike fashion in the depression can also be of two-ply design, and the section 520, which can be inserted into the lamp holder, of the contact lugs 5, 6 can be of single-ply design in order, for example, to utilize the spring action of the section of two-ply design for the purpose of achieving a clamping action.

What is claimed is:

1. A reflector for an electric lamp, the reflector comprising: a reflector body with an inner side, designed in an optically reflecting fashion, and an outer side as well as at least one cutout for the lamp or for a lamp part, and at least one metallic contact element that is designed as an angular contact lug being fastened on said outer side of the reflector body, wherein said reflector body consists of an electrically insulating plastic, and said at least one contact lug is fixed to at least two different locations of said reflector body with the aid of claws or barbs that are integrally formed on said at least one contact lug, wherein the reflector body has at least one pin integrally formed on the outer side of said reflector body, and a first limb of the at least one contact lug has a cutout in which said at least one pin is arranged with a clamping fit, said cutout being provided with said claws or barbs.

2. A reflector for an electric lamp, the reflector comprising: a reflector body with an inner side, designed in an optically reflecting fashion, and an outer side as well as at least one cutout for the lamp or for a lamp part, and at least one metallic contact element that is designed as an angular contact lug being fastened on said outer side of the reflector body, wherein said reflector body consists of an electrically insulating plastic, and said at least one contact lug is fixed to at least two different locations of said reflector body with the aid of claws or barbs that are integrally formed on said at least one contact lug, wherein the reflector body has on its outer side at least one depression in which there is arranged a part of said contact lug that extends transverse to a first limb of said at least one metallic contact lug, said part of the at least one metallic contact lug that extends transverse to said first limb being provided with said claws or barbs.

3. The reflector as claimed in claim 2, wherein said at least one metallic contact lug has a second limb that is angled off from said first limb, and said part of the metallic contact lug extending transverse to said first limb being designed as a component of said second limb.

4. The reflector as claimed in claim 3, wherein at least one section of said second limb is of two-ply design.

5. A reflector lamp comprising: a reflector and an electric lamp arranged in said reflector, wherein said electric lamp has at least one supply lead, projecting from a lamp vessel, for a luminous means enclosed in said lamp vessel, said reflector has a reflector body with an inner side, designed in an optically reflecting fashion, and an outer side, said reflector body having at least one cutout, through which said at least one supply lead is led, and at least one metallic contact element that is fastened on its outer side and is connected to the at least one supply lead, and is designed as an angular contact lug, wherein said reflector body consists of an electrically insulating plastic, and said at least one contact lug is fixed to at least two different locations of said reflector body with the aid of claws or barbs that are integrally formed on said at least one contact lug, and wherein the reflector body has at least one pin integrally formed on the outer side of said reflector body, and a first limb of said at least one contact lug has a cutout in which said at least one pin is arranged with a clamping fit, said cutout being provided with said claws or barbs.

6. The reflector lamp as claimed in claim 5, wherein said first limb of the at least one contact lug has a further cutout in which the at least one supply lead is arranged.

7. A reflector lamp comprising: a reflector and an electric lamp arranged in said reflector, wherein said electric lamp has at least one supply lead, projecting from a lamp vessel, for a luminous means enclosed in said lamp vessel, said reflector has a reflector body with an inner side, designed in an optically reflecting fashion, and an outer side, said reflector body having at least one cutout, through which said at least one supply lead is led, and at least one metallic contact element that is fastened on its outer side and is connected to the at least one supply lead, and is designed as an angular contact lug, wherein said reflector body consists of an electrically insulating plastic, and said at least one contact lug is fixed to at least two different locations of said reflector body with the aid of claws or barbs that are integrally formed on said at least one contact lug, and wherein the reflector body has on its outer side at least one depression in which there is arranged a part of said metallic contact lug that extends transverse to a first limb of said at least one metallic contact lug, said part of the at least one metallic contact lug that extends transverse to said first limb being provided with said claws or barbs.

8. The reflector lamp as claimed in claim 7, wherein said at least one metallic contact lug has a second limb that is angled off from said first limb, and the part of said metallic contact lug extending transverse to said first limb being designed as a component of the second limb.

9. The reflector lamp as claimed in claim 8, wherein at least one section of said second limb is of two-ply design.

10. The reflector lamp as claimed in claim 7, wherein said first limb of the at least one contact lug has a further cutout in which the at least one supply lead is arranged.

* * * * *